US006012897A

United States Patent [19]

Sabnis et al.

[11] Patent Number: 6,012,897

[45] Date of Patent: Jan. 11, 2000

[54] FREE ROTOR STABILIZATION

[75] Inventors: Jayant S. Sabnis; Daniel L. Gysling, both of Glastonbury, Conn.

[73] Assignee: Carrier Corporation, Syracuse, N.Y.

[21] Appl. No.: 08/880,851

[22] Filed: Jun. 23, 1997

[51] Int. Cl.[7] ..... F04D 27/02

[52] U.S. Cl. ..... 415/62; 415/68; 415/69; 415/147; 415/119

[58] Field of Search ..... 415/60, 62, 66, 415/67, 68, 69, 119, 143, 147, 151, 159, 160; 417/407

[56] References Cited

U.S. PATENT DOCUMENTS

| | | | |
|---|---|---|---|
| 2,555,312 | 6/1951 | Bollay | 415/66 |
| 3,918,828 | 11/1975 | Kumm | 415/62 |
| 4,449,888 | 5/1984 | Balje | 415/62 |
| 4,780,055 | 10/1988 | Zloch et al. | 415/160 |
| 5,096,374 | 3/1992 | Sakai et al. | 415/159 |
| 5,437,539 | 8/1995 | Gysling et al. . | |

FOREIGN PATENT DOCUMENTS

| | | |
|---|---|---|
| 0 477 740 | 4/1992 | European Pat. Off. . |
| 98 63 0025 | 9/1998 | European Pat. Off. . |
| 63-21399 | of 0000 | Japan . |
| 5-26200 | 2/1993 | Japan . |
| 08093682 | 4/1996 | Japan . |

*Primary Examiner*—Christopher Verdier

[57] ABSTRACT

In a turbo compressor, such as a centrifugal compressor, having swirl inducing structure, such as inlet guide vanes, one or more free rotors are located intermediate the swirl inducing structure and the inlet of the compressor. The free rotors are driven by the flow and the kinetic energy stored therein serves to mitigate transient changes in the flow as perceived at the inlet of the compressor such that a more stable operation results.

11 Claims, 4 Drawing Sheets

FREE ROTOR STABILIZATION

BACKGROUND OF THE INVENTION

One of the major problems arising in the use of centrifugal gas compressors for applications where the compression load varies over a wide range is flow stabilization through the compressor. The compressor inlet, impeller and diffuser passage must be sized to provide for the maximum volumetric flow rate desired. In centrifugal refrigerant compressors, the loads typically vary over a wide range and they may be operated at such low flow rates that their inlets and diffusers are too large for efficient operation. When there is a low volumetric flow rate through such a compressor, the flow becomes unstable. As the volumetric flow rate is decreased from a stable range, a range of slightly unstable flow is entered. In this range, flow in both the impeller and the diffuser becomes separated from the wall along the entire length of the flow passage and there appears to be a partial reversal of flow in the diffuser passage creating noises and lowering the compressor efficiency. When the mass flow is decreased further, the compressor encounters what is known as surge, wherein there are periodic complete flow reversals in the compressor destroying the ability of the machine to do useful work.

Various techniques have been used to increase the range between the surge and choke limits of a compressor.

Guide vanes located in the inlet of the compressor have been employed to vary the flow direction and quantity of the entering gas since the work done by an impeller is proportional to the difference of the square of the gas velocity at the impeller exit and the impeller inlet. Inlet guide vanes improve efficiency because they impart a swirl to the gas at the impeller inlet in the direction of rotation thus reducing the velocity difference. The lift capability of the compressor is also reduced, but for normal air conditioning applications this is no problem because the required lift also falls off as load decreases. Sometimes, mechanically connected to these guide vanes is movable diffuser structure to throttle the diffuser passage as the inlet flow is reduced.

As evidenced by U.S. Pat. No. 5,437,529, free rotors (freely rotating rotors) may be used as a part of the apparatus used for the dynamic control of rotating stall and surge in turbo machines such as compressors. The device of this patent has the limitation that its effectiveness is dependent upon the speed of rotation of the freely rotating rotor, which, in turn, is proportional to the volumetric flow rate. Therefore, when the compressor operates in the low flow regions of the compressor map (region in which the flow is less than design flow), the free rotor slows down and its effectiveness is reduced. Unfortunately, achieving a given amount of effectiveness in the low flow region results in high free rotor speeds when the compressor is operating at the design condition. High free rotor speeds increase the manufacturing cost and increase the pressure loss across the free rotor, thereby reducing its practical implementation.

The effectiveness of the free rotor described in U.S. Pat. No. 5,437,529 is expressed as $\phi\ (\tan\gamma)^2$, where $\phi$ is the flow coefficient (defined as the ratio of the gas axial velocity component at the compressor inlet to the impeller tip speed) and $\gamma$ is the stagger angle for the free rotor blades. As the compressor mass flow is reduced, $\phi$ reduces and, hence, the effectiveness of the free rotor reduces as well.

SUMMARY OF THE INVENTION

The present invention is directed to the suppression of surge in compression systems where the swirl at the inlet to the compression system is varied to accommodate the changing load. The system includes a rotor which does not provide a turning of the gas and which is mounted so that it is nominally spinning freely in a flow. The rotor is located upstream of the compressor inlet and downstream of the variable swirl device, such as inlet guide vanes. Rotating stall suppression is an additional benefit on certain systems requiring no additional feedback.

Several compressors utilize variable inlet swirl to reduce the compressor mass flow. Variable inlet swirl can be produced, for example, by inlet guide vanes that can be rotated to change their stagger angle. If the free-rotor is mounted between such inlet guide vanes and the compressor inlet, the operating characteristics of the free-rotor are altered significantly. In addition to the free rotor stagger angle and the compressor mass flow, the effectiveness of the free rotor becomes a function of the inlet flow swirl angle. The effectiveness of the free-rotor deployed as described herein can be shown to be $\phi\ (\tan\gamma - \tan\alpha)^2$, where $\alpha$ is the inlet swirl angle (measured positive along the direction of compressor rotation). Hence, if the free-rotor were to be designed so that $\gamma$ is negative (i.e., blades are staggered opposite to the direction of compressor rotation), the free-rotor effectiveness can be increased as the inlet swirl (i.e., $\alpha$) increases.

It is an object of this invention to suppress surge in compression systems.

It is another object of this invention to provide a surge suppressing device whose effectiveness increases as the inlet swirl increases. These objects, and others as will become apparent hereinafter, are accomplished by the present invention.

Basically, at least one free rotor is located between the compressor inlet and the variable swirl device of a compression system.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
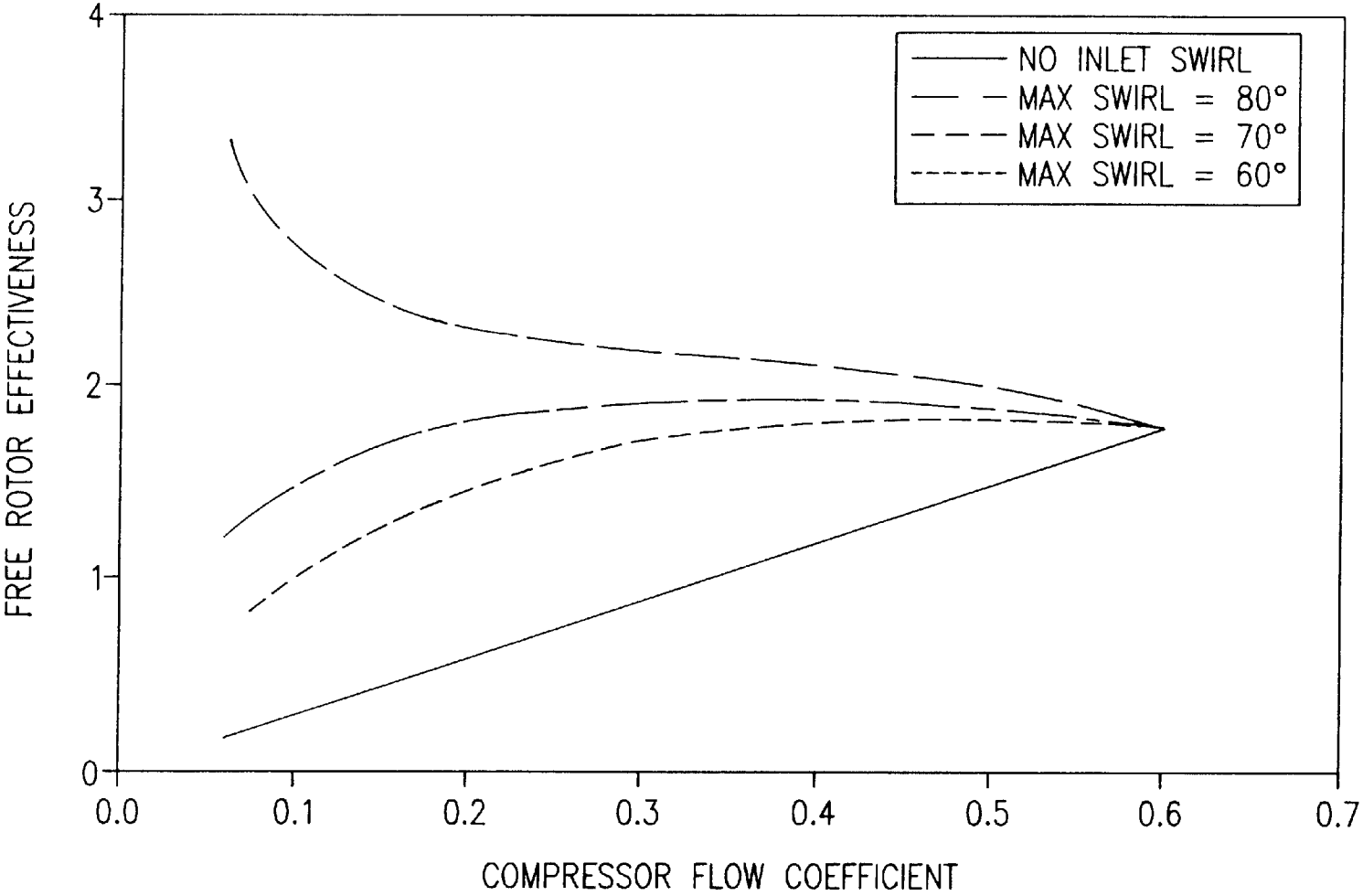
FIG. 1 is a plot of free rotor effectiveness vs. relative compressor mass flow for various maximum inlet swirl angles where the inlet flow swirl varies linearly with compressor mass flow.
Figure 2:
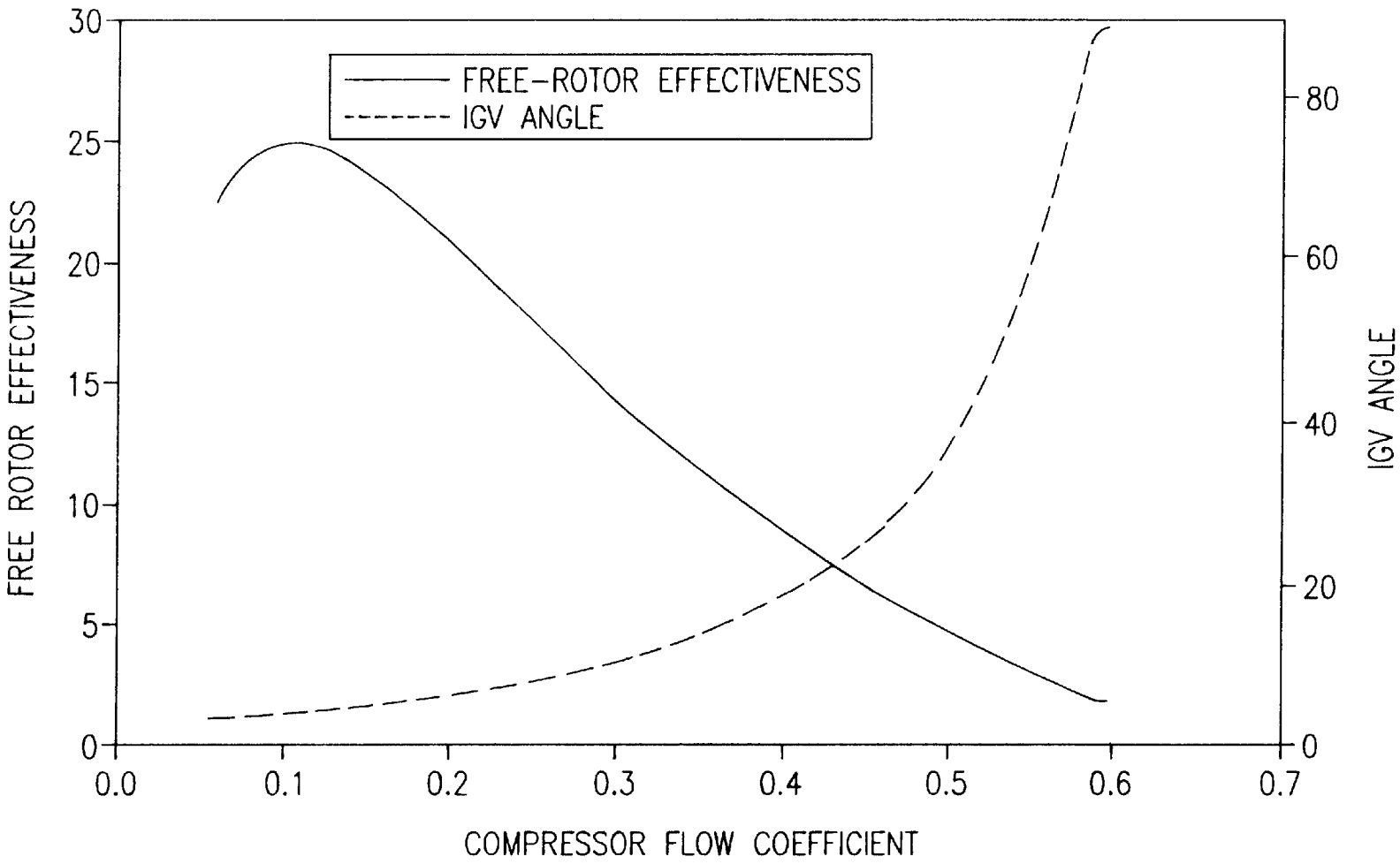
FIG. 2 presents plots of free rotor effectiveness and inlet guide vane angle (measured from perpendicular to the impeller axis) vs. relative compressor design mass flow for a typical centrifugal chiller system where inlet swirl does not vary linearly with mass flow.

In a typical application, such as the centrifugal compressor in a chiller, the inlet swirl angle can be as high as 80°, or larger, when the compressor mass flow is 10% of the design mass flow. This mass flow range could typically represent flow coefficient values between 0.6 (design flow) and 0.06 (10% of design flow). If the variation of inlet swirl angle with the mass flow were assumed to be linear (i.e., if, for example, the inlet guide vane stagger angle were scheduled as a linear function of compressor mass flow), the variation of free-rotor effectiveness with mass flow for different maximum swirl angles (i.e., the swirl angle at minimum mass flow) is shown in FIG. 1. FIG. 1 also shows the effectiveness variation for a free-rotor without the pre-swirl. As can be seen from this figure, pre-swirl can significantly enhance the free-rotor effectiveness. In a typical application, such as a centrifugal chiller, the inlet swirl angle variation with mass flow is not linear. This can influence the free-rotor effectiveness. FIG. 2 illustrates this for a typical centrifugal chiller application where the variation of inlet swirl with mass flow and the resulting free-rotor effectiveness variation are shown. The variation of inlet swirl with the compressor mass flow is typically highly non-linear and the inlet swirl angle can be significantly larger, e.g. 85°. Also, the free rotor effectiveness is much greater as will be noted by comparing the abscissae of FIGS. 1 and 2. With 90° representing the closed position of the inlet guide vanes, going from 80° to 85° represents a nominal halving of the flow area and the value of tan $\alpha$ goes from about 5 to about 11. The significant increase in the free-rotor effectiveness at low mass flow conditions (where it is most needed) allows one to design the rotor to rotate at lower speeds at nominal design conditions, thereby reducing pressure losses and decreasing manufacturing costs. The free-rotor can be mounted on an extension of the compressor shaft so that the free-rotor bearing speeds would be low, thereby reducing bearing losses.

The inclusion of the free-rotor between the inlet guide vanes and the compressor inlet has an additional benefit for compressors with low hub-to-tip diameter ratio. Since the inlet guide vanes add swirl such that the swirl angle is fixed at all radial locations, this is not a solid body rotation. Hence, there is incidence angle mismatch at the compressor. The blade geometry for the free-rotor could be designed to mitigate this effect.

Figure 3:
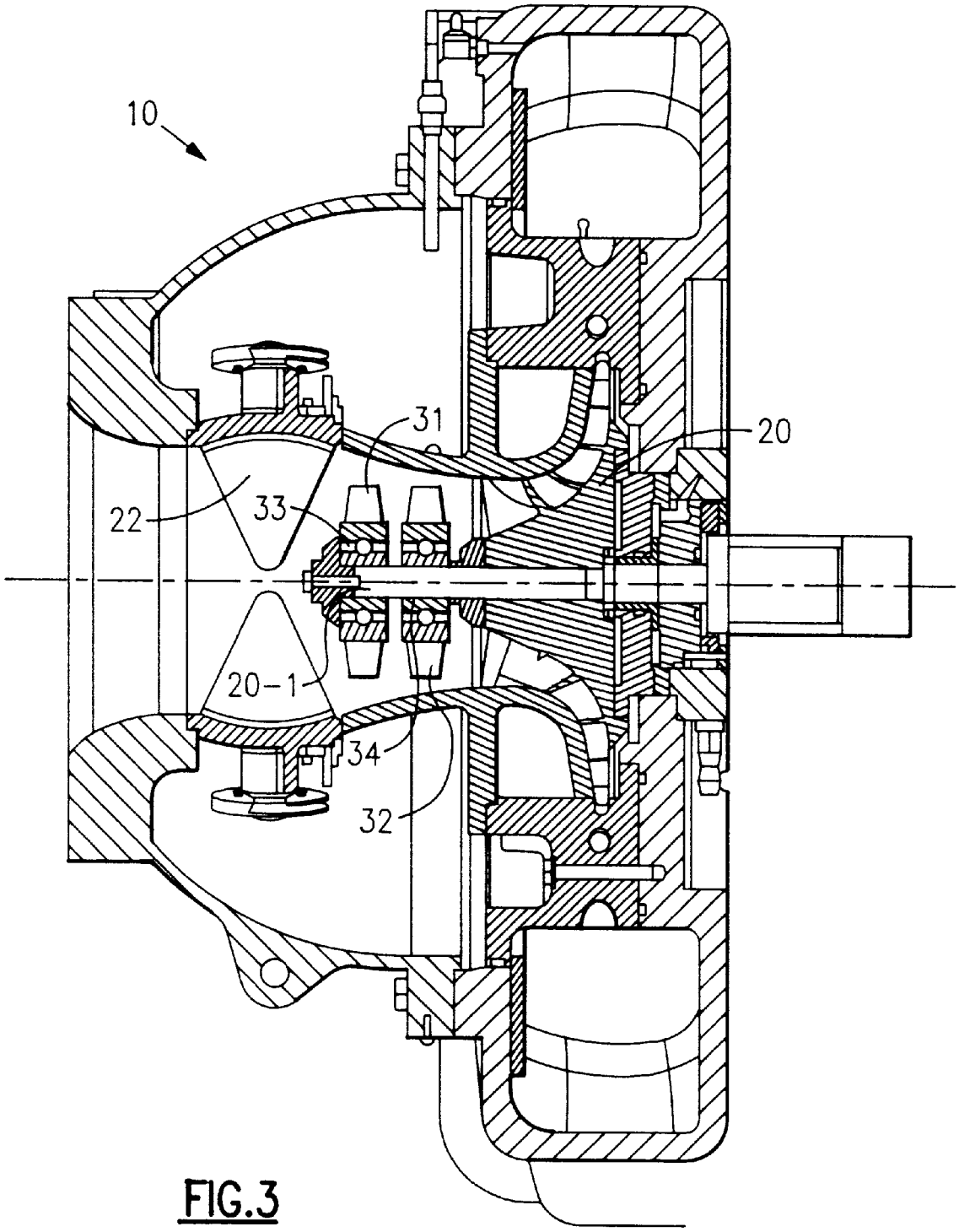
FIG. 3 is a sectional view of a centrifugal compressor system employing a first embodiment of the present invention.

In FIG. 3, the numeral 10 generally designates the turbo compressor portion of a centrifugal chiller. Specifically, the turbo compressor portion 10 includes a centrifugal compressor having impeller 20 with inlet guide vanes 22 located upstream, as is conventional. The present invention adds one or more free rotors, 31 and 32, between inlet guide vanes 22 and the inlet to centrifugal compressor impeller 20. The free rotors 31 and 32 are freely rotatably supported on an overhung portion of impeller drive shaft 20-1. As illustrated, free rotors 31 and 32 are located on shaft 20-1 through suitable bearings 33 and 34, respectively. Where plural free rotors are employed, one may be counter-rotating with respect to the other.

In the absence of free rotors 31 and 32, flow to compressor impeller 20 is controlled by inlet guide vanes 22 which act as valves in controlling the flow while providing a spin to the flow. The spin provided to the flow increases with increasing inlet guide vane angle which corresponds to reduced flow. Assuming, the guide vanes 22 are at 0°, aligned with the flow, they provide no valving action and provide no spin to the flow. The free rotors 31 and 32 will be brought up to a speed such that they provide no turning to the flow which passes through to the inlet of compressor impeller 20, as is the case of the device of U.S. Pat. No. 5,437,539. However, in the present invention, as the inlet guide vanes 22 move towards closing, the resultant swirl imposed upon the flow tends to cause the flow to impact against free rotors 31 and 32 causing them to speed up to accommodate the new flow direction. After the speed of the free rotor adjusts to the new equilibrium speed, the free rotor has no effect on the annulus averaged, time mean flow angle across the free rotor. However, for unsteady oscillations, such as those associated with surge, the free rotor acts to damp out the oscillations, similar to that described in the U.S. Pat. No. 5,437,539.

Figure 4:
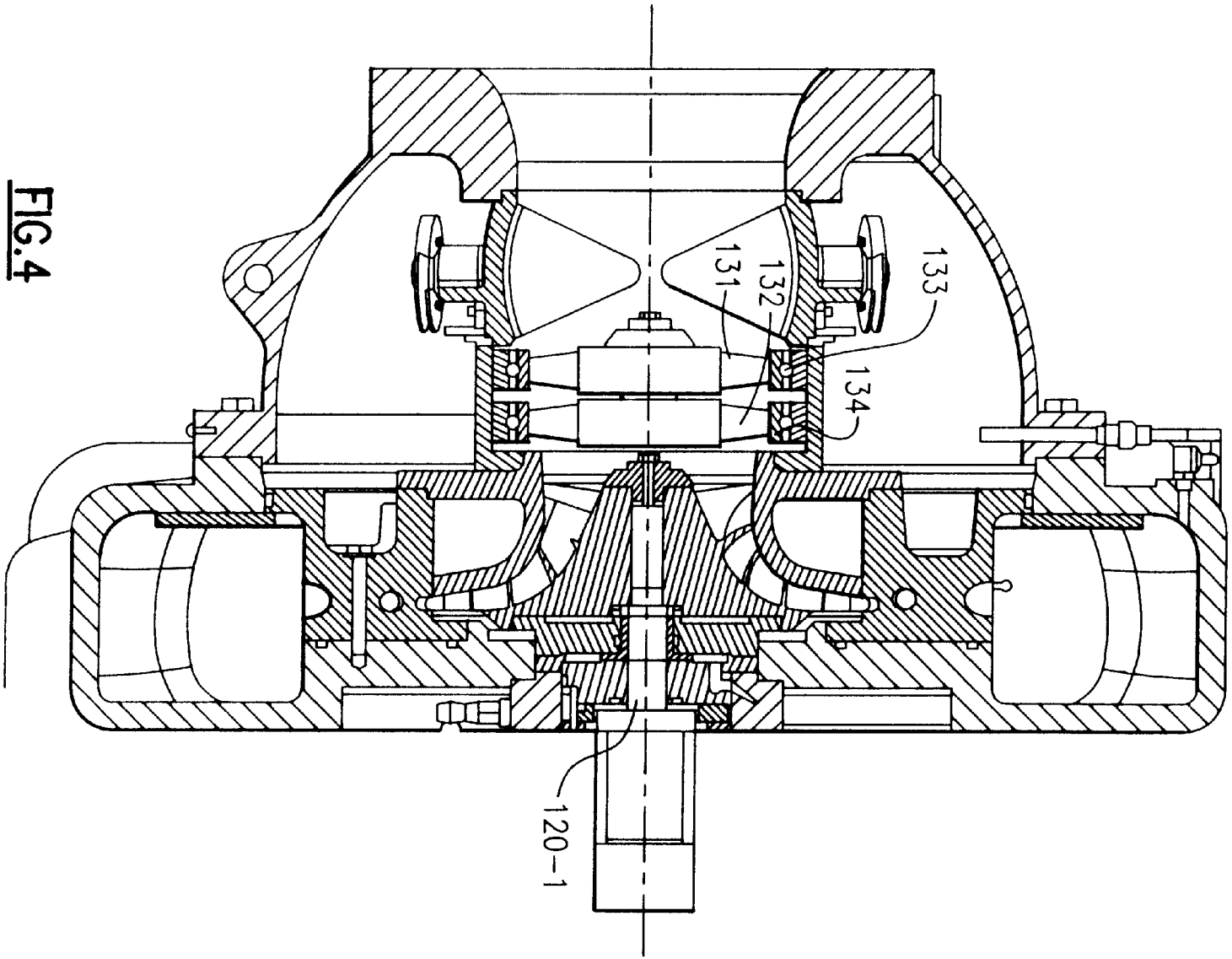
FIG. 4 is a sectional view of a centrifugal compressor system employing a second embodiment of the present invention.

The embodiment of FIG. 4 differs from that of FIG. 3 in the support of the free rotors 131 and 132. Rather than being supported on an overhung shaft, as in the FIG. 3 embodiment, shaft 120-1 does not coact with free rotors 131 and 132. Specifically, rather than being supported internally by bearing structure, as in the FIG. 3 embodiment, free rotors 131 and 132 are freely rotatingly supported at the outer circumference by suitable bearings 133 and 134, respectively. Other than the differences associated with the supporting of free rotors 131 and 132, the operation of turbo compressor 110 would be the same as that of turbo compressor 10.

Although the present invention has been illustrated and described in terms of a centrifugal compressor having inlet guide vanes, the invention is generally applicable to turbocompressors having a swirl imposed upon the inlet flow. It is therefore intended that the scope of the present invention is to be limited only by the scope of the appended claims.

What is claimed is:

1. A compressor arrangement comprising:

a turbo compressor having an inlet;

means for providing a flow to said inlet;

means for selectively providing a swirl to said flow to said inlet;

means for damping changes in said flow;

said means for damping being located intermediate said means for selectively providing a swirl and said inlet whereby a more stable flow is supplied to said inlet.

2. The arrangement of claim 1 wherein said means for damping includes a free rotor.

3. The arrangement of claim 1 wherein said means for damping includes at least two free rotors having opposite directions of rotation.

4. The arrangement of claim 1 wherein said turbo compressor is a centrifugal compressor and said means for selectively providing a swirl includes inlet guide vanes.

5. The arrangement of claim 4 wherein said means for damping includes a free rotor.

6. The arrangement of claim 5 wherein said free rotor is rotatingly supported by a bearing.

7. The arrangement of claim 6 wherein said bearing is located internally of said free rotor.

8. The arrangement of claim 6 wherein said bearing is located externally of said free rotor.

9. The arrangement of claim 4 wherein said means for damping includes at least two free rotors rotatingly supported by bearings and having opposite directions of rotation.

10. The arrangement of claim 9 wherein said bearings are located internally of said free rotors.

11. The arrangement of claim 9 wherein said bearings are located externally of said free rotors.

* * * * *